US005470058A

United States Patent [19]

Sullivan et al.

[11] Patent Number: 5,470,058

[45] Date of Patent: Nov. 28, 1995

[54] HIGH VISIBILITY INFLATED GAME BALL

[75] Inventors: Michael J. Sullivan, Chicopee; R. Dennis Nesbitt, Westfield, both of Mass.

[73] Assignee: Lisco, Inc., Tampa, Fla.

[21] Appl. No.: 316,699

[22] Filed: Sep. 30, 1994

[51] Int. Cl.[6] ..... A63B 41/02; A63B 41/10

[52] U.S. Cl. ..... 273/65 B; 273/65 E; 273/65 EB; 273/65 ED; 273/DIG. 24; 273/58 BA; 29/899.1; 40/327

[58] Field of Search ..... 273/65 R, 58 B, 273/58 BA, DIG. 24, 65 E, 65 ED, 65 B; 29/899, 899.1; 40/327; 273/213

[56] References Cited

U.S. PATENT DOCUMENTS

| | | | |
|---|---|---|---|
| 3,207,514 | 9/1965 | Vickery | 273/63 |
| 3,458,205 | 7/1969 | Smith et al. | 273/213 |
| 3,863,923 | 2/1975 | Anderson | 273/58 BA |
| 3,980,300 | 9/1976 | Hornsby | 273/58 |
| 4,116,439 | 9/1978 | Chavarria et al. | 273/59 A |
| 4,679,795 | 7/1987 | Melvin et al. | 273/235 R |
| 4,798,386 | 1/1989 | Berard | 273/235 R |
| 4,867,452 | 9/1989 | Finley | 273/65 E |
| 5,091,265 | 2/1992 | Kennedy et al. | 428/690 |
| 5,181,717 | 1/1993 | Donntag et al. | 273/58 BA |
| 5,251,337 | 10/1993 | Sloot | 2/243.1 |
| 5,320,345 | 6/1994 | Lai et al. | 273/58 R |

*Primary Examiner*—George J. Marlo

[57] ABSTRACT

A high visibility inflated game ball such as a basketball, football, soccer ball or volleyball. The game ball includes a central inflated portion and a synthetic rubber cover formed over the central inflated portion. The cover has fluorescent pigment, fluorescent dye, and/or optical brighteners incorporated therein in order to impart to the cover a reflectance of at least 75% in at least a portion of the visible spectrum. In another embodiment, reflective metallic particles are incorporated in addition to, or in place of the pigment, dye and optical brightener in order to add a glittery appearance to the ball cover. The particularly preferred game ball of the invention is a basketball, and is particularly useful at dusk when conventional basketballs of a dull orange color become difficult to see.

23 Claims, 5 Drawing Sheets

HIGH VISIBILITY INFLATED GAME BALL

FIELD OF THE INVENTION

The present invention relates generally to inflated game balls, and more particularly to inflated, rubber covered game balls having enhanced visibility.

BACKGROUND OF THE INVENTION

A conventional inflated game ball has a central inflated black rubber bladder which is covered by a winding of natural or synthetic filaments. As an alternative to a wound bladder, a durable, synthetic non-wound carcass can be employed which is molded from a polymeric material. The carcass or wound bladder is covered with a leather or rubber cover formed from natural or synthetic materials.

Rubber covers for basketballs typically are formed from orange tinted styrene butadiene rubber or natural rubber, both of which are sulfur cured materials. These rubber covers are opaque, and the orange color of the balls is rather dull as a result of the sulfur curing. Thus, basketballs of this type have limited visibility at dusk, and therefore are disadvantageous in that a difficulty in accurately perceiving the exact location and/or speed of the ball in flight can result in injury to a player, particularly at an advanced level of play.

Vinyl basketballs have been produced which have substantially brighter coloring than the synthetic or natural rubber covered basketballs. However, vinyl basketballs are inferior to rubber basketballs in gripability or tackiness as well as scuff resistance, and therefore are considered to be of lower quality.

SUMMARY OF THE INVENTION

An object of the invention is to provide a high visibility inflated game ball.

Another object of the invention is to provide an inflated game ball with the safety feature that it is more readily visible at dusk than a conventional game ball.

Yet another object of the invention is to provide a high visibility game ball of superior quality.

Yet another object of the invention is to provide a basketball having a reduced likelihood of causing injury during use after sunset.

A further object of the invention is to provide a method of forming a game ball having the features described above.

Other objects of the invention will be in part obvious and in part pointed out more in detail hereinafter.

The invention in a preferred form is a high visibility game ball comprising a central inflated portion and a cover formed over the central inflated portion. The cover includes a plurality of panels at least one of which comprises a peroxide cured synthetic rubber and a tinting agent for enhancing the visibility of the ball. The portion of the basketball including this panel has a reflectance of at least 75%, more preferably at least 85%, and most preferably over 100% in a part of the visible spectrum.

Throughout this application, reflectance is to be understood as being based upon ASTM E-313-73.

The peroxide cured synthetic rubber preferably includes ethylene propylene diene monomer (EPDM), ethylene propylene rubber (EPR) or a blend of EPDM with polyisoprene and/or polybutadiene rubbers.

In a particularly preferred form of the invention, the tinting agent includes at least one member selected from the group consisting of fluorescent dyes, fluorescent pigments and optical brighteners. The tinting agent is added to the peroxide cured synthetic rubber in an amount sufficient to provide the desired degree of enhanced visibility. Typically, an optical brightener is added to the synthetic rubber in an amount of about 0.05–2.0 parts by weight, a fluorescent pigment is added in an amount of about 0.5–5.0 parts by weight, and a fluorescent dye is included in an amount of about 0.05–2.0 parts by weight, each being based upon 100 parts by weight of synthetic rubber. In a particularly preferred form of the invention, the fluorescent materials can provide the ball with twice the reflectance as would result from the use of a non-fluorescent material providing a non-fluorescent counterpart of generally the same color.

The cover of the game ball preferably is translucent. Thus, in order to enhance the reflectance of the cover, the central inflated portion of the ball, which is partially visible through the cover, preferably has a white or light-colored outer surface with a reflectance of at least about 40% in a part of the visible spectrum, and more preferably a reflectance of at least 40% throughout the visible spectrum.

Another preferred form of the invention is a high visibility game ball having a central inflated portion and a translucent cover formed over the inflated portion, the cover including at least one panel formed from a synthetic rubber material with reflective particles dispersed therein which have faces with a reflectance of at least 75%, more preferably at least 95%. Preferably, the synthetic rubber is peroxide cured, and more preferably includes EPDM, EPR or blends of EPDM with polyisoprene and/or polybutadiene rubbers. The reflective particles preferably comprise at least one member selected from the group consisting of metal flake, metallized film, colored polyester foil, and iridescent glitter, such as aluminized Mylar.

Further preferred forms of the invention are methods of forming high visibility game balls of the types described above.

The invention accordingly consists in the features of construction, combination of elements and arrangement of parts, as well as the several steps which will be exemplified in the construction hereafter set forth and the scope of the application which will be indicated in the appended claims.

DETAILED DESCRIPTION OF THE INVENTION

Figure 1:
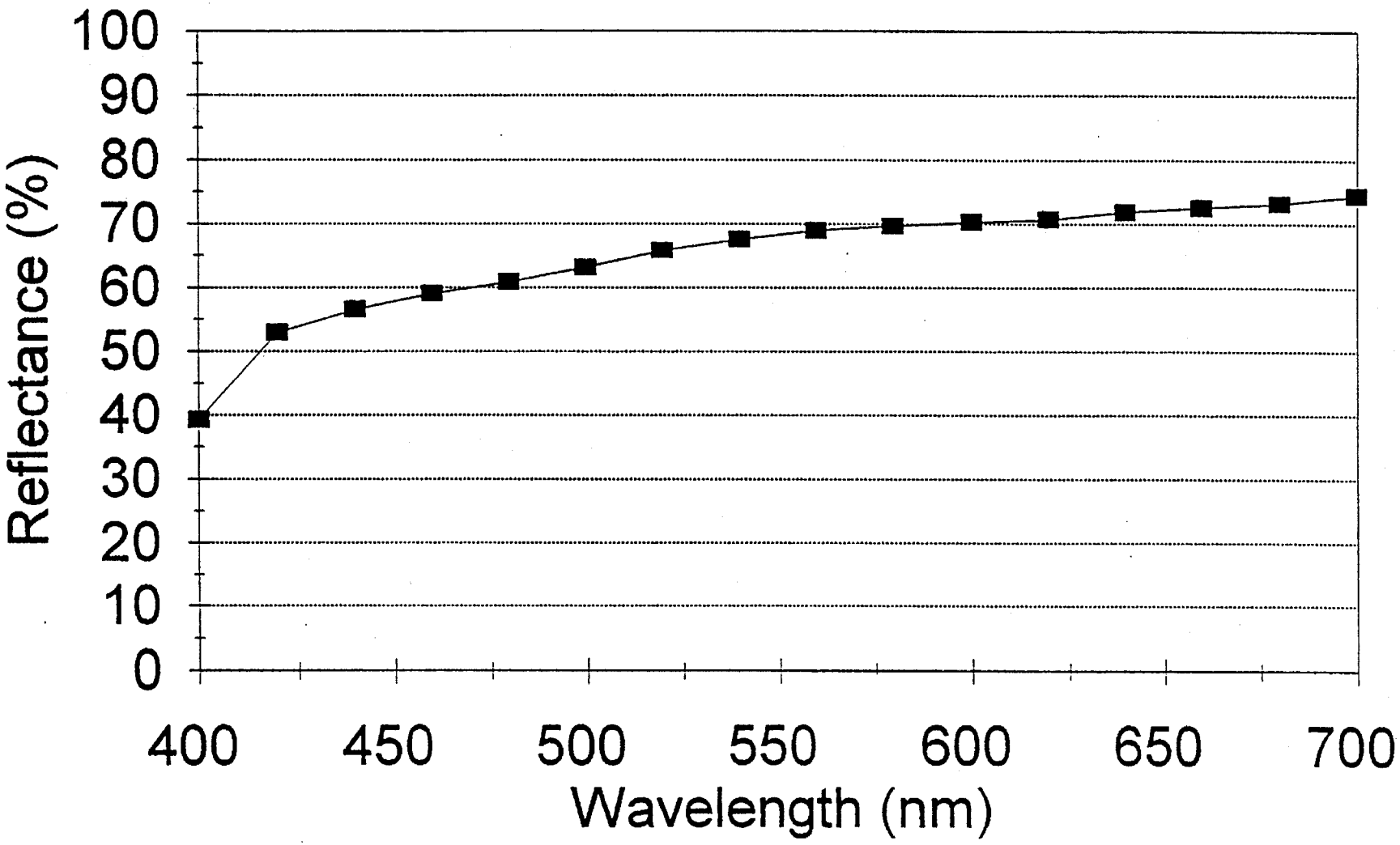
FIG. 1 is a graph showing the reflectance of the bladder which is used in the fluorescent basketballs of examples 1–6 of the present invention.

The game ball of the invention can be a basketball, football, volleyball, soccer ball, or other type of inflated ball with a rubber cover. In the most preferred form, the game ball constitutes a basketball.

The cover of the game ball is visually enhanced through the incorporation of fluorescent materials, optical brighteners, or highly reflective particles. The game ball is not a glow-in-the-dark ball, and therefore it is not necessary to place the ball beneath a bright light before it exhibits properties of enhanced visibility. Furthermore, the cover is not illuminated by a power source such as a battery. The cover on the high visibility game ball preferably is translucent.

The present invention also includes game balls having thermochromatic and photochromatic covers with enhanced visibility. Such covers are formed by adding thermochromatic or photochromatic materials to the uncured cover material.

The central inflated portion of the game ball can be of conventional construction. Bladders typically are made of butyl rubber, natural rubber, halobutyl rubber blends with synthetic or natural rubber, or in certain cases, urethane. The bladder is wound with an adhesive-coated white or light-colored monofilament polymeric strand, frequently made of nylon or a nylon/polyester blend. For a basketball, about 2100 meters of winding is used. Conventional bladders are colored black. The combination of the black bladder and the light windings imparts a mottled black and white appearance to the outer surface of the central inflated portion. In accordance with the present invention, it is preferable to color the bladder white instead of black, or to provide sufficient windings in order to completely cover any underlying dark surface, thereby imparting to the outer surface of the central inflated portion a light-colored appearance with a reflectance of at least 40% in part or all of the visible spectrum. This construction is particularly advantageous when the cover which is placed over the central inflated portion is highly translucent, as the light color of the central inflated portion then contributes to the reflectance of the cover. It is also noted that the central inflated portion can be made by techniques which do not require windings, but instead have an internal carcass. Furthermore, a wound bladder can be covered with an overlying middle carcass-type layer, such as a middle layer of synthetic or natural rubber which has outwardly-extending ribs in a pattern corresponding to the black lines normally visible on the outer surface of a basketball. When this construction is used, the color of the bladder and windings usually is irrelevant and the middle carcass-type cover preferably is light-colored in order to contribute to the reflectance of the ball.

The cover is non-vinyl, and is formed from a peroxide-cured rubber material such as EPDM, EPR, or blends of EPDM with polyisoprene and/or polybutadiene rubber. In a blend, EPDM preferably is present in an amount of at least 50 wt % and more preferably about 70–90 wt %, polyisoprene is present in an amount of up to about 30 wt % and preferably about 20 wt %, and polybutadiene is present in an amount of up to about 20 wt % and preferably about 10 wt %.

If a high visibility ball such as a basketball is to have cover panels which are all the same color, the cover can be made by forming two cover halves from a well-blended and calendered mixture of peroxide-curable rubber, a peroxide curing agent, and a tinting agent such as a fluorescent dye, fluorescent pigment or optical brightener. Reinforcing agents and co-agents can be added in order to enhance the strength and other physical properties of the synthetic rubber. The cover halves are then placed in two halves of a mold, the bladder is inserted and inflated, and the mold is closed. The uncured ball with a weakly adhered cover is then removed and cured under heat and pressure in a pebbled mold. Black lines are then painted on the ball in a conventional pattern to define the individual panels.

If a game ball such as a basketball is to have panels of different colors, the cover material containing synthetic rubber, peroxide, tinting agent, and, optionally, reinforcing agents and co-agents, is blended, calendered into sheet form and die cut to panel size. The panels are cold formed to shape around a wound bladder in two halves of a mold.

In a ball having panels of different colors, one or more of the panels may be formed of high visibility material. For example, a multicolored ball according to the invention can have alternating colors on adjacent panels. For purposes of this application, the term "panel" refers to a section of the ball cover which is surrounded by a black outline. Typically, a basketball has eight panels.

As indicated above, a suitable synthetic rubber for use in this invention is EPDM. Several commercially available types of EPDM are Nordel, sold by DuPont (Wilmington, Del.), Polysar, sold by Polysar, which is a subsidiary or division of Miles Inc. (Pittsburgh, Pa.) which in turn is owned by Bayer of Germany, and Vistalon, sold by Exxon Corp. (Irving, Tex.). Ethylene propylene diene monomer results in the production of a high-quality cover having good durability, gripability and translucence. Because ethylene propylene diene monomer is peroxide cured, rather than sulfur cured, the resulting color of the ball is brighter and has higher visibility than a cover which includes a tinting agent incorporated into a sulfur-cured rubber. The cover of the invention typically has a thickness of about 0.60–3.0 mm, and more preferably 1.5–2.3 mm.

The tinting agent can be any material which enhances the visibility of the ball such that it has a reflectance of at least 75%, preferably at least 85%, and more preferably at least 100% at a range of wavelengths in the visible spectrum. Reflectance values of over 100% can be achieved when fluorescent coloring is used, because the fluorescent material absorbs energy in the ultraviolet region and emits the absorbed energy as fluorescence in the visible region. The wavelengths at which high reflectance occurs will depend upon the color of the basketball at a particular panel. For purposes of this application, the visible spectrum is considered to be in the range of about 400 to about 770 nm. Red objects reflect light primarily in the range of about 622–770 nm. Orange objects have high reflectance in the range of about 597–622 nm. Yellow objects have the highest reflectance in the range of about 570–597 nm. Blue objects have the highest reflectance in the range of about 420–492 nm. The particularly preferred tinting agents are fluorescent dyes, fluorescent pigments and optical brighteners. The fluorescent dyes, fluorescent pigments and optical brighteners are found to increase reflectance within a specific range of wavelengths. Combinations of dyes, pigments and optical brighteners can be used.

If fluorescent dyes are used, the cover generally will have a highly translucent, i.e. nearly transparent, appearance. If fluorescent pigments and/or powdered optical brighteners are used, the cover will be translucent as long as sufficiently low quantities of these coloring materials are used. In a translucent ball with an ethylene propylene diene monomer cover, some of the fluorescent pigment and/or optical brightener which is visible is situated at the outer surface of the cover, other portions of the pigment or brightener which is visible are situated in the middle of the cover, and still other portions are found along the inner surface of the cover. Preferably, the translucence of the cover is such that light can be seen through a sample of the cover material which is not adhered to the ball, but the pigmented cover material preferably is not transparent enough for standard-type text to be legible through the cover material. A reduction in visibility may result if an amount of pigment and/or optical brightener which results in an opaque cover, as compared to a translucent cover, is used, due to the contribution of the bladder to the reflectance of the ball.

When the tinting agent is a pigment which is used alone, it has been found that about 0.5–5.0 parts by weight of pigment preferably are used, and more preferably 1–3 parts by weight, or optimally 1.5–2.5 parts by weight based upon 100 parts by weight of synthetic rubber. Preferably, the pigment is fluorescent orange, yellow or red, or a combination thereof.

The quantities of dye to be used to achieve a particular color are about one-tenth the pigment quantities. Preferably, when used alone, dye is present in an amount of about 0.05–2.0 parts by weight, more preferably 0.075–1.0 parts by weight, and most preferably 0.1–0.50 based upon 100 parts by weight of synthetic rubber. Preferred dye colors are orange, yellow and red, and mixtures thereof. It is noted that pigment and dye can be used in combination. Depending on the type of dye which is used, it may be advantageous to include a thin, clear synthetic finish coating over a dyed cover in order to prevent any bleeding of the dye. Non-limiting examples of suitable coatings are soft polyurethane, epoxy and acrylic materials.

It has been found that in forming a translucent basketball cover having a thickness of about 0.60–3.0 mm, about 0.05–2.0 parts by weight of an optical brightener, when used alone, more preferably 0.075–1.0 parts by weight, and most preferably 0.1–0.5 pans by weight of optical brightener based upon 100 pans by weight of synthetic rubber will increase the reflectance of the ball. Reflectance is found to increase by at least 20% as a result of the addition of optical brightener.

Commonly, small amounts of optical brightener are used in conjunction with a pigment or dye. In this case, the optical brightener preferably is used in amount of about 0.1–0.5 parts by weight based upon 100 pans by weight of synthetic rubber.

Higher quantities of the dyes, pigments and optical brighteners can be used, however, in most cases the use of larger quantities will not be justified economically because in most cases little benefit in visibility would be obtained from the use of higher quantities.

As an alternative, or in addition, to using fluorescent dyes, fluorescent pigments and optical brighteners to visually enhance the game ball of the invention, highly reflective particles can be dispersed in the cover material to produce a game ball with a glittery cover. The particles which are on the outer surface will have a sparkly appearance, while those in the middle and near the inner surface of the cover will have a less sparkly but nevertheless highly reflective appearance. The translucence of the cover material allows for the reflective particles which are not on the outer surface of the cover to be seen. These particles can be used in conjunction with bright red, yellow and orange materials, and also with other colors, e.g. blue, green, violet and black pigments or dyes. The reflective particles can be any small particulate material which does not adversely affect the properties of the synthetic rubber cover. Preferably, the reflective material comprises at least one member selected from the group consisting of metal flake, iridescent glitter metallized film and colored polyester foil. The reflective particles preferably have faces which have an individual reflectance of over 75%, more preferably at least 95%, and most preferably 99–100%. For example, flat particles with two opposite faces can be used.

The maximum particle size of the reflective particles should be smaller than the thickness of the cover, and preferably is very small. The particle size preferably is 0.1 mm–1.0 mm more preferably 0.2 mm–0.8 mm, and most preferably 0.25 mm–0.5 mm. The quantity of reflective particles may vary widely, as it will depend upon the desired effect and is best determined experimentally. In general, an aesthetically pleasing reflective appearance can be obtained by using about 0.2–5, or more preferably 1–4 parts by weight reflective particles based upon 100 parts by weight of synthetic rubber for producing a cover having a thickness of about 1.5–2.3 mm.

One of the advantages of the translucent covers of the present invention are that smaller amounts of dye, pigment, optical brightener and/or metal flake are needed than would be required if the covers were made of an opaque material. If an opaque cover were formed, it would be necessary to have complete color coverage on tile outer surface of the cover. However, in accordance with the present invention pigment, dye and reflective particles which are well beneath the outer surface, as well as the carcass or wound bladder, contribute to the high visibility of the cover.

The game ball of the present invention can be made in the following manner. The central inflated portion can be formed using a conventional technique with the exception that the central bladder or carcass preferably contains white instead of black pigment. The bladder includes a valve for inflating the ball. After reinforcing fibers are wound around the bladder (if a bladder is used), the synthetic rubber cover material containing ethylene propylene diene monomer is blended with an appropriate quantity of fluorescent dye, fluorescent pigment, reflective particles and/or optical brightener, peroxide crosslinker, and additives such as co-agents and reinforcing agents, if desired, using conventional rubber mixing equipment such as an open mill or internal mixer. The ethylene propylene diene monomer blend is either (1) molded directly around the inflated portion by vacuum-molding, followed by hot curing at a temperature-time combination in the range of between about 121° C. for about 15 minutes or 177° C. for about 5 minutes, or more typically 150° C. for about 7 minutes, followed by at least 2 minutes in a cold water bath, or (2) panels of the synthetic rubber cover material containing ethylene propylene diene monomer are die cut to size, molded around the wound bladder and cured under the same hot and cold conditions described in (1) above.

Having generally described the invention, the following examples are included for purposes of illustration so that the invention may be more readily understood and are in no way intended to limit the scope of the invention unless otherwise specifically indicated.

Example 1

A basketball was made having a central inflated portion comprising a whitish bromo butyl/natural rubber bladder wound with whitish nylon, having the reflectance shown in FIG. 1. The reflectance of the central inflated portion was relatively high, i.e. 40–75% throughout the visible spectrum because of its off-white color, and therefore the central inflated portion reflected substantial quantities of light throughout the range of visible wavelengths. Reflectance of the central inflated portion, and of the covered basketballs described below, was measured in accordance with ASTM E-313-73.

A cover having a thickness of 1.9 mm with a pebbled outer surface was molded over the central inflated portion as eight separate panels of the same color. The cover had the composition shown in Table 1, and the covered ball was cured for 7 minutes at 150° C.

TABLE 1

COVER COMPOSITION

| Component | Parts by Weight |
|---|---|
| Low viscosity EPDM[1] | 80 |
| Fast curing EPDM[2] | 20 |
| reinforcing agent[3] | 15 |
| coagent to improve physical properties of EPDM[4] | 6 |
| coagent to improve strength of bonds between EPDM and fillers[5] | 0.6 |
| peroxide[6] | 3.0 |
| orange fluorescent coloring[7] | 2.0 |
| | 126.6 |

[1]Nordel EPDM 1320, available from DuPont Far East, Inc., Suite 601 - 6th Floor., World Trade Center, 1 Maritime Square, Singapore 0409
[2]Nordel EPDM 1660, available from DuPont Far East, Inc., Suite 601 - 6th Floor., World Trade Center, 1 Maritime Square, Singapore 0409
[3]HiSil 233, sold by PPG Industries, Inc., One PPG Place, Pittsburgh, PA 15272
[4]SR-350, available from Sartomer Company, Inc., 202 Thomson Road #15-01A, United Square, Singapore 1130
[5]A-172, available from Union Carbide Asia Pacific, Inc., 22/F Treasury Building, 8 Shenton Way, Singapore 0106
[6]Varox 231, sold by R. T. Vanderbuilt Co., Inc., 30 Winfield Street, P.O. Box 5150, Norwalk, CT 06856
[7]Day-Glo Color Corp., 4515 St Clair Avenue, Cleveland, OH 44103

The above-described composition resulted in a fluorescent orange basketball with a translucent fluorescent orange cover. After customary black lines were painted on the basketball, the reflectance of a colored panel of the basketball was measured over a range of 400–700 nm, and was compared to the reflectance of a panel of a standard orange rubber basketball with a cover made from natural and synthetic rubber which was sulfur cured. As indicated on FIG. 2, the fluorescent orange basketball exhibited a reflectance of as high as 150% at about 620 nm, and had a high reflectance in the orange spectrum, i.e. including the range from about 597–622 nm, and even up to about 660 nm. The fluorescent coloring resulted in a reflectance greater than 100% because the fluorescent material was able to absorb energy in the ultraviolet region and emit fluorescence in visible region. Thus, this ball is substantially more visible under low-light and daylight conditions than the standard orange rubber basketball, which has a maximum reflectance of only about 63%. The reflectance of the fluorescent ball was more than twice the reflectance of a non-fluorescent ball of generally the same color.

Example 2

Figure 3:
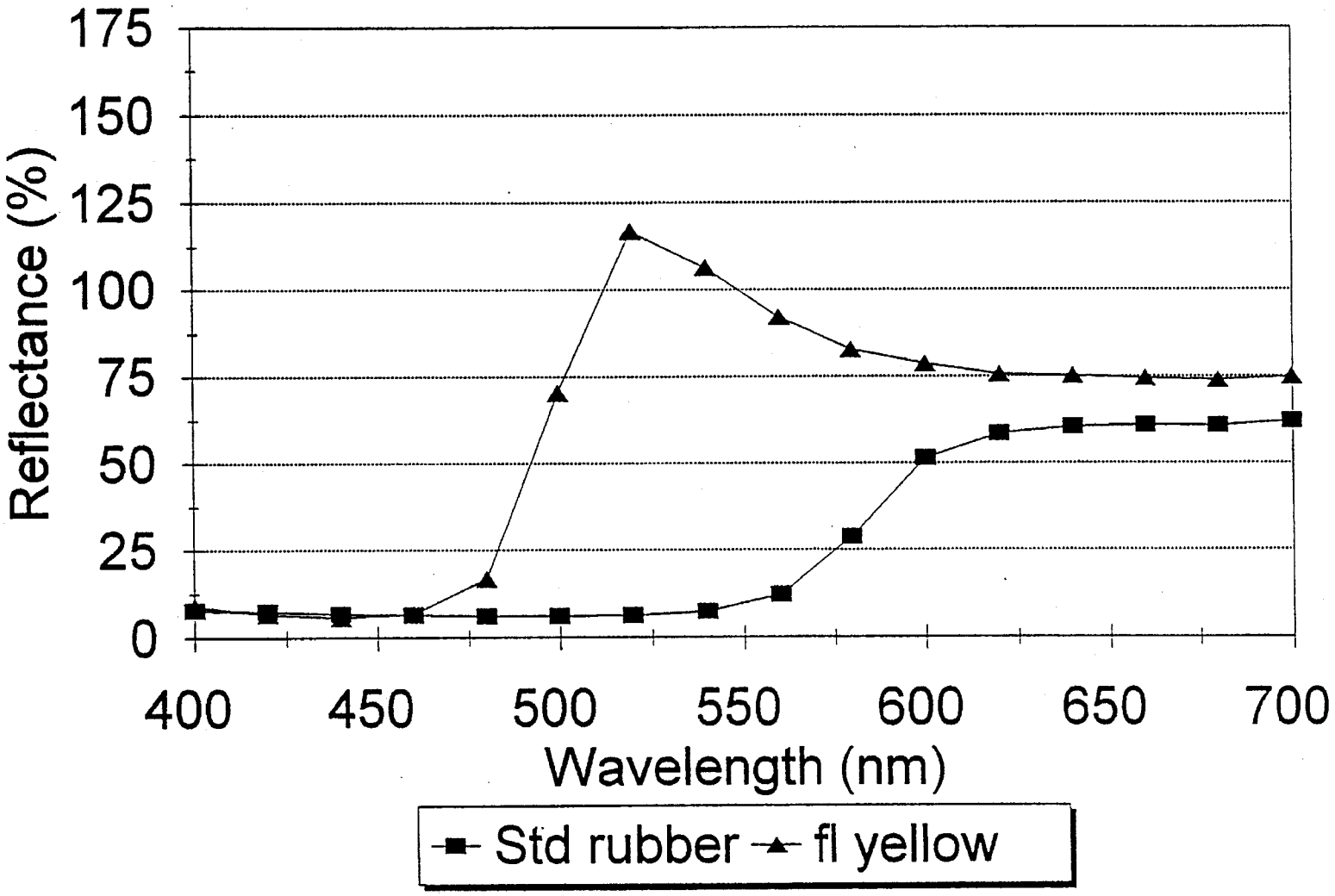
FIG. 3 is a graph showing the reflectance of a standard orange basketball and the fluorescent yellow basketball of Example 2.

A basketball was formed according to the same process as is described in Example 1 above, with the exception that the orange fluorescent coloring was replaced by 2 pans by weight of yellow fluorescent coloring which was obtained from Day Glo Color Corp., 4515 St. Clair Ave., Cleveland, Ohio 44103. The reflectance of the resulting basketball was compared with the reflectance of the same standard orange rubber basketball as was used for comparison purposes in Example 1, and the results are shown on FIG. 3. As shown in FIG. 3, the fluorescent yellow cover had a reflectance of about 120% at about 520 nm. Thus, the yellow fluorescent basketball has substantially higher visibility than a standard orange rubber basketball.

Example 3

Figure 4:
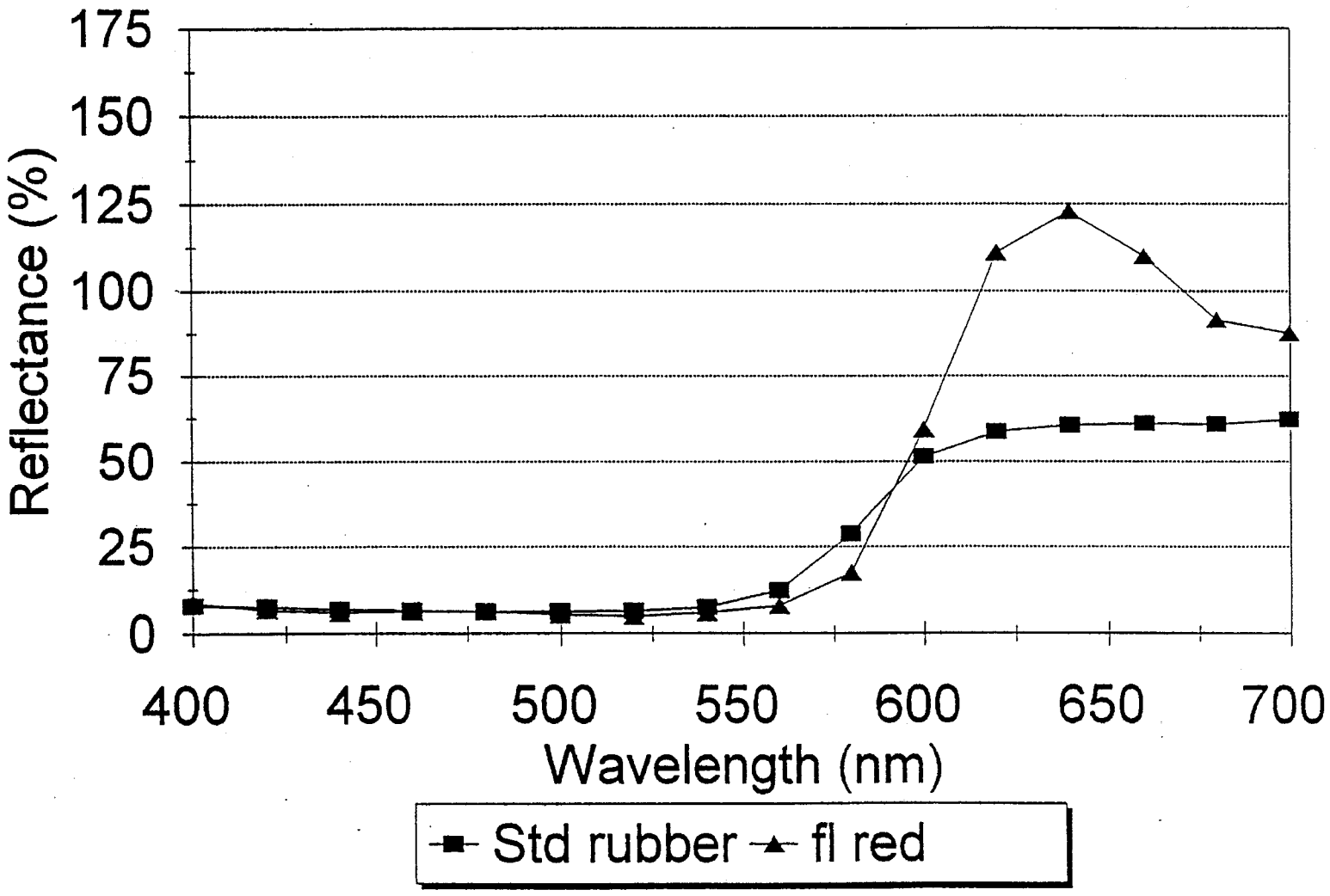
FIG. 4 is a graph showing the reflectance of a standard orange basketball and the fluorescent red basketball of Example 3.

A basketball was formed by the process described in Example 1 with the exception that the orange fluorescent coloring was replaced by 1.5 pans by weight of red fluorescent coloring which was obtained from Day-Glo Color Corp., 4515 St. Clair Ave., Cleveland, Ohio 44103 and was sold as Rocket Red GT-13. The reflectance of the resulting basketball was measured and was compared with the reflectance of a standard orange rubber basketball in FIG. 4. As shown in FIG. 4, the fluorescent red basketball had a reflectance of 125% at about 640 nm, which is substantially higher than the maximum reflectance of the standard basketball.

Example 4

Figure 5:
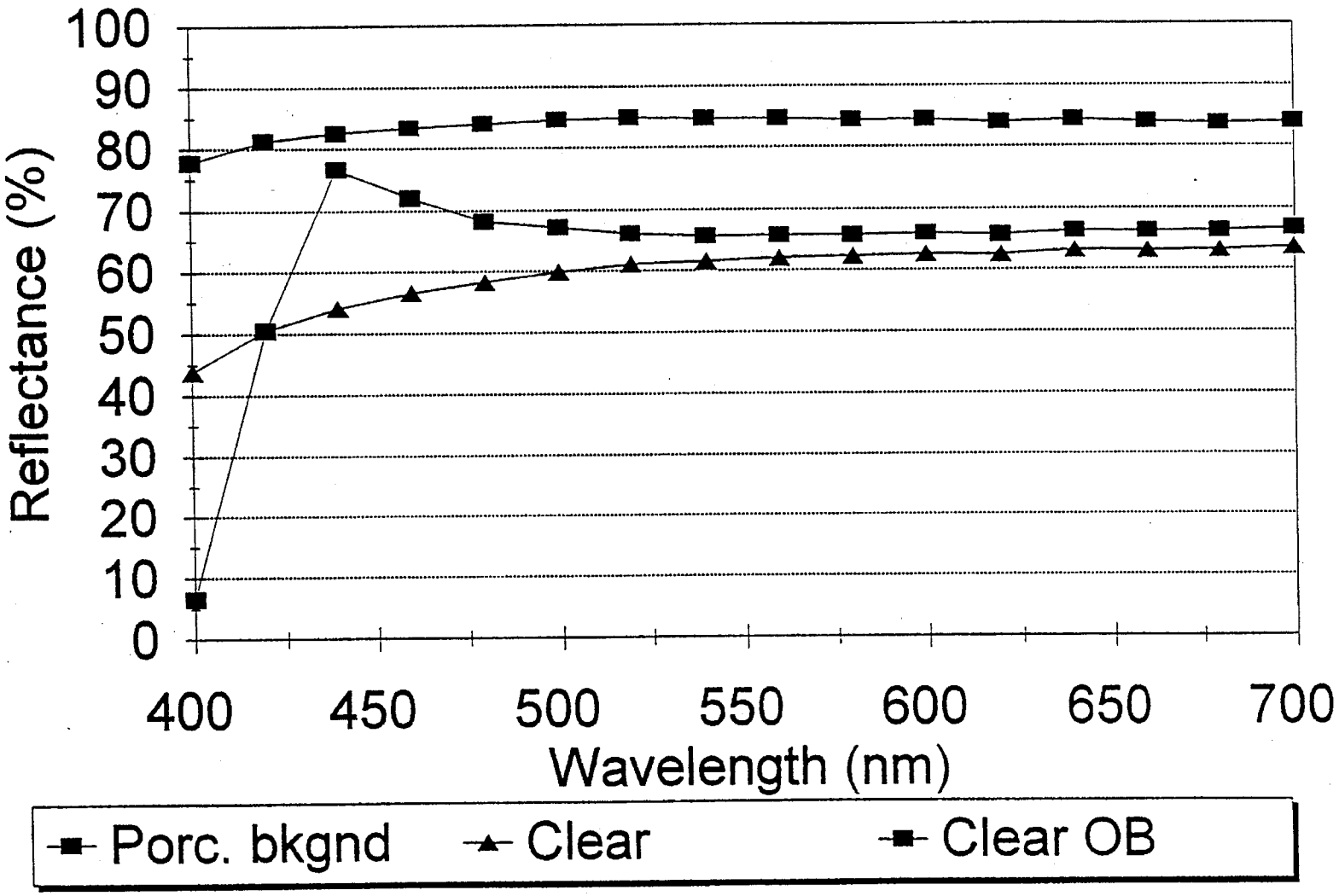
FIG. 5 is a graph showing the reflectance of (a) a basketball having a clear cover without optical brightener, (b) a basketball having a clear cover containing optical brightener, and (c) the porcelain background upon which the two clear covers were placed in order to obtain reflectance data.

A basketball was formed from the process described in Example 1 with the exception that the orange fluorescent coloring was replaced by 0.1 parts by weight of optical brightener known as Uvitex OB, which was obtained from Ciba-Geigy, Additives Division, Seven Skyline Drive, Hawthorne, N.Y. 10532-2188. A sample of the basketball cover material was obtained and placed on a porcelain background, and its reflectance was measured. The reflectance of the sample was compared to the reflectance of a sample of a clear basketball cover material which was formed from a cover having a composition which did not contain optical brightener but was otherwise identical, and which was placed on the same porcelain background. The reflectance of the porcelain itself also was determined. As shown in FIG. 5, the optical brightener-containing cover material, when on a porcelain background, had a reflectance of over 75–85% in the visible spectrum. The reflectance of the clear cover material which did not contain optical brightener was about 43–62%. The difference in reflectance between the cover containing optical brightener and the cover which did not contain optical brightener was about 20–30%.

Example 5

A basketball was formed according to the process of Example 1 except that the orange fluorescent coloring was replaced by 1.0 parts by weight blue fluorescent coloring sold as Horizon Blue T-19 by Day-Glo Color Corp. Additionally, 0.50 parts by weight of flat, square metal flakes measuring 0.008" by 0.008" sold as Alpha Jewels by Meadowbrook Inventions, Inc., P.O. Box 360, Bernardsville, N.J. 07924 were added to the cover material. The resulting ball had a glittery appearance in which light reflected off the reflective particles in a mirror-like manner, thus enhancing the visibility of the ball.

Example 6

The fluorescent yellow, orange and red balls obtained in Examples 1–3 and the conventional orange control ball which was used as a basis for in an amount of about 0.05–2.0 parts by weight, more preferably 0.075–1.0 comparison in Examples 1–3 were taken outside at dusk and were observed at distances from 5 feet to 150 feet. The fluorescent yellow ball was the brightest, followed by the fluorescent orange ball, the fluorescent red ball, and, finally, the conventional orange ball. At one point just before dark, the three fluorescent balls were visible from about 30–50 feet away while the control ball was not visible.

Figure 2:
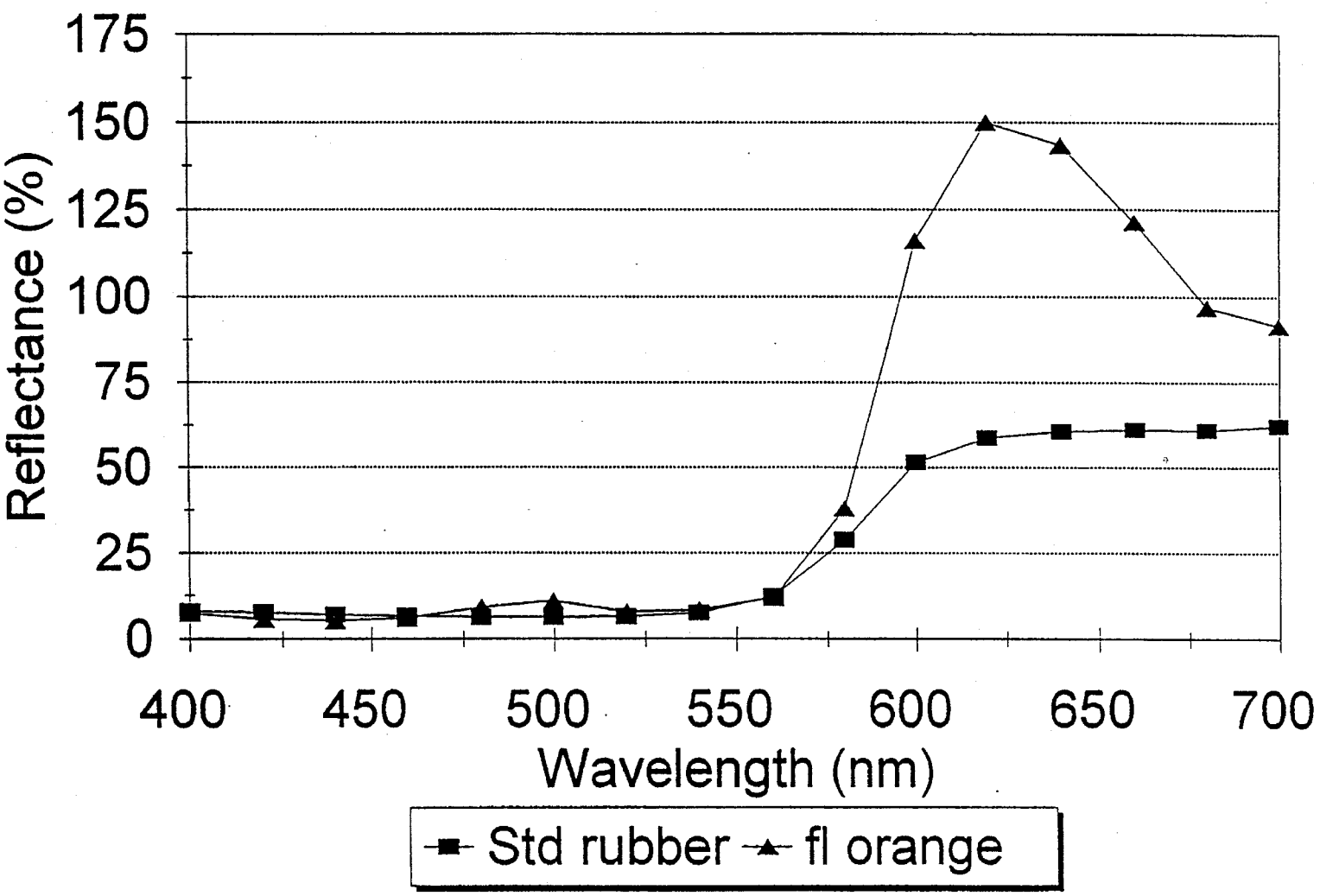
FIG. 2 is a graph showing the reflectance of a standard orange basketball and the fluorescent orange basketball of Example 1.

The results of this test are consistent with the reflectance measurements which are shown on FIGS. 1–3. The maximum reflectance of the fluorescent yellow ball was in the 500–550 nm range, while the maximum reflectance of the fluorescent orange and red balls was in the 600–650 nm range. The human eye is more sensitive to light in the 500–550 nm range than in the 600–650 nm range. The 1–12% greater reflectance of the standard orange ball as compared to the fluorescent red ball in the range of 500–600 nm is deemed insubstantial in view of the 10–60% greater reflectance of the fluorescent red ball as compared to the standard orange ball in the range of 600–700 nm.

What is claimed is:

1. A high visibility game ball, comprising:

a central inflated portion, and a cover formed over said central inflated portion, said cover including a plurality of panels at least one of which comprises a peroxide cured synthetic rubber and a tinting agent for enhancing the visibility of the ball, a portion of said ball which includes said at least one panel having a reflectance of at least 75% in a part of the visible spectrum.

2. A game ball according to claim 1, wherein said tinting agent includes at least one member selected from the group consisting of fluorescent dyes, fluorescent pigments, and optical brighteners.

3. A game ball according to claim 1, wherein said peroxide cured synthetic rubber comprises a member selected from the group consisting of ethylene propylene diene monomer, ethylene propylene rubber, and a blend of ethylene propylene diene monomer with at least one of polyisoprene rubber and polybutadiene rubber.

4. A game ball according to claim 1, wherein said tinting agent includes about 0.05–2.0 parts by weight of an optical brightener based upon 100 parts by weight of synthetic rubber.

5. A game ball according to claim 1, wherein said tinting agent includes about 0.5–5.0 parts by weight of a fluorescent pigment based upon 100 parts by weight of synthetic rubber.

6. A game ball according to claim 1, wherein said tinting agent includes about 0.05–2.0 parts by weight of a fluorescent dye based upon 100 parts by weight of synthetic rubber.

7. A game ball according to claim 6, wherein said ball further includes a clear, synthetic finish coating over said cover.

8. A game ball according to claim 1, wherein said central inflated portion has an outer surface with a reflectance of at least about 40% in a part of the visible spectrum.

9. A game ball according to claim 1, wherein said cover has a thickness, and said at least one panel further includes highly reflective particles with a maximum particle size which is smaller than said thickness of said cover.

10. A game ball according to claim 1, wherein said ball is a basketball.

11. A game ball according to claim 1, wherein said cover is translucent.

12. A game ball according to claim 1, wherein said portion of said ball which includes said at least one panel has a reflectance of at least 100% in a part of the visible spectrum.

13. A high visibility game ball comprising:

a central inflated portion, and a translucent cover formed over said central inflated portion, said covering including a plurality of panels, at least one of which comprises a synthetic rubber and a material for enhancing the visibility of the ball, said material including a member selected from the group consisting of reflective particles having faces with a reflectance of at least 75%, and a tinting agent which imparts to at least a portion of the cover panel a reflectance of at least 75% in a part of the visible spectrum.

14. A game ball according to claim 13, wherein said material for enhancing the visibility of the ball includes reflective particles which comprise at least one member selected from the group consisting of metal flake, iridescent glitter, metallized film, and colored polyester foil.

15. A game ball according to claim 13, wherein said at least one panel contains about 0.2–1.5 parts by weight of reflective particles based upon 100 parts by weight of synthetic rubber.

16. A game ball according to claim 13, wherein said material for enhancing the visibility of the ball includes reflective particles having faces with a reflectance of at least 95%.

17. A method of forming a high visibility game ball, comprising the steps of:

forming a central inflated portion, and forming a cover over said central inflated portion, said cover including a plurality of panels at least one of which comprises a peroxide cured synthetic rubber and a tinting agent for enhancing the visibility of the ball, said tinting agent being present in an amount sufficient to provide a portion of said ball which includes said at least one panel with a reflectance of at least 75% in a portion of the visible spectrum.

18. A method according to claim 17, wherein said peroxide cured synthetic rubber comprises a member selected from the group consisting of ethylene propylene diene monomer, ethylene propylene rubber, and a blend of ethylene propylene diene monomer with at least one of polyisoprene rubber and polybutadiene rubber.

19. A method according to claim 17, wherein said tinting agent includes at least one member selected from the group consisting of fluorescent dyes, fluorescent pigments, and optical brighteners.

20. A method according to claim 17, wherein said tinting agent is present in a quantity sufficient to provide that said cover is translucent.

21. A method according to claim 17, where the step of forming said cover includes providing said portion of said ball which includes said at least one panel with a reflectance of at least 100% in a portion of the visible spectrum.

22. A method according to claim 17, further comprising the step of forming a clear synthetic finish coating over said cover.

23. A method of forming a high visibility game ball, comprising:

forming a central inflated portion, and forming a translucent synthetic rubber cover over said central inflated portion, said cover including a plurality of panels, at least one of which comprises a synthetic rubber and a material for enhancing the visibility of the ball, said material including a member selected from the group consisting of reflective particles having faces with a reflectance of at least 75% and a tinting agent which imparts to at least a portion of the cover panel a reflectance of at least 75% in a part of the visible spectrum.

* * * * *